United States Patent [19]

Ozaki et al.

[11] 4,352,705

[45] Oct. 5, 1982

[54] PROCESS FOR THE PREPARATION OF LEATHERLIKE SHEET MATERIALS

[75] Inventors: Kiyotaka Ozaki; Michikage Matsui, both of Ibaraki; Norihiro Minemura, Takatsuki, all of Japan

[73] Assignee: Teijin Limited, Osaka, Japan

[21] Appl. No.: 279,871

[22] Filed: Jul. 2, 1981

Related U.S. Application Data

[63] Continuation-in-part of Ser. No. 129,310, Mar. 11, 1980, abandoned, which is a continuation of Ser. No. 934,784, Aug. 18, 1978, abandoned.

[30] Foreign Application Priority Data

Sep. 6, 1977 [JP] Japan ..... 52-106290
Sep. 6, 1977 [JP] Japan ..... 52-106291
Sep. 6, 1977 [JP] Japan ..... 52-106292

[51] Int. Cl.[3] ..... B32B 5/02

[52] U.S. Cl. ..... 156/155; 156/168; 156/296; 428/91; 428/398; 428/904

[58] Field of Search ..... 156/168, 72, 167, 155, 156/154, 181, 296; 428/91, 398, 904, 85, 96, 97, 374

[56] References Cited

U.S. PATENT DOCUMENTS 3,705,226 12/1972 Okamoto et al. ..... 428/91
3,718,534 2/1973 Okamoto et al. ..... 264/DIG. 26
4,051,287 9/1977 Hayashi et al. ..... 428/398

FOREIGN PATENT DOCUMENTS 51-48402 4/1976 Japan .

*Primary Examiner*—Michael W. Ball
*Attorney, Agent, or Firm*—Sughrue, Mion, Zinn, Macpeak & Seas

[57] ABSTRACT

A process for the preparation of leatherlike sheet materials which comprises: preparing hollow composite fibers, each composed of 32 to 72 alternately arranged segments of polyester or polyamide and polystyrene which are mutually adhered side-by-side and encompass a hollow space, and which extend along the longitudinal axis of the fiber to form a tubular body, the hollow composite fiber having a denier of 1 to 20, and each segment having a denier of 0.01 to 0.5; forming a fabric using thus prepared hollow composite fibers; removing the polystyrene segments with a solvent thereof from the hollow composite fibers; and applying an elastic polymer to the fabric. The resultant leatherlike sheet materials have fine touch, excellent repulsive elasticity and excellent wrinkle resistance similar to natural suede. The hollow ratio (ratio by volume of the hollow space to the sum of the volume of the polyester or polyamide segments, the polystyrene segments and the hollow space) is 2-15%.

14 Claims, 4 Drawing Figures

PROCESS FOR THE PREPARATION OF LEATHERLIKE SHEET MATERIALS

CROSS-REFERENCE TO RELATED APPLICATION

This application is a continuation-in-part of U.S. Ser. No. 129,310, filed Mar. 11, 1980, now abandoned, which in turn is a continuation of U.S. Ser. No. 934,784, filed Aug. 18, 1978 (now abandoned), both entitled "Process for the Preparation of Leather-Like Materials" in the name of Kiyotaka Ozaki et al.

BACKGROUND OF THE INVENTION

1. Field of the Invention

The present invention relates to a process for the preparation of leatherlike sheet materials. More particularly, the present invention is concerned with a process for manufacturing leatherlike sheet materials from hollow composite fibers of a type which generates extra fine fibers, each hollow composite fiber composed of polyester or polyamide segments and polystyrene segments.

2. Description of the Prior Art

Heretofore, it has been known to produce leatherlike sheet materials using extra fine fibers. U.S. Pat. No. 4,051,287, issued on Sept. 27, 1977 to Hayashi et al and U.S. Patent Application Ser. No. 799,818, filed on May 23, 1977, now U.S. Pat. No. 4,109,038 by Ozaki et al disclose a suede-like woven or knitted fabric (a leatherlike sheet material) which was produced by applying an elastic polymer to a raised woven or knitted fabric comprising extra fine fibers obtained from hollow composite fibers, the hollow composite fiber being composed of at least four alternately arranged segments of fiber-forming polyester and fiber-forming polyamide which are mutually adhered side-by-side encompassing a hollow space and which extend along the longitudinal axis of the fiber to form a tubular body. This hollow composite fiber has the advantages that the segments of the hollow composite fiber are readily separable by mechanical action to form extra fine fibers and all the segments are usable as extra fine fibers. The obtained extra fine fibers, however, must be dyed by a very complicated process, because they consist of two polymers having properties different from each other.

U.S. Pat. No. 3,865,678, issued on Feb. 11, 1975 to Okamoto et al, discloses a suede-like raised woven fabric (a leatherlike sheet material) which was produced by applying an elastic polymer to a raised woven fabric comprising extra fine fibers obtained from islands-in-sea type composite fibers. The islands-in-sea type composite fiber can be converted into a bundle of the island component fibers (extra fine fibers) by removing the sea component from the composite fiber. However, the islands-in-sea type composite fiber has the disadvantages that a spinneret having a complicated structure must be employed in the manufacturing process of the islands-in-sea type composite fiber and further the process control is very difficult.

Japanese Patent Application Laid-Open No. 48402/76, Takemura et al, published on Apr. 26, 1976 discloses a hollow composite fiber which is divisible into fine fibers, and a leatherlike sheet material which is obtained by applying a polyurethane to a non-woven fabric formed with the hollow composite fibers. As for a divisible polymer combination, the Japanese Patent Application discloses the combination of polyamide and polyethylene terephthalate, polyethylene terephthalate and polystyrene, and also polyamide and polystyrene. However, the Japanese Patent Application neither teaches the denier of the fine fibers nor suggests the structure of the hollow composite fiber composed of polyester or polyamide and polystyrene segments.

According to the experiments conducted by the present inventors, it was very difficult to produce a hollow composite fiber having good properties composed of polyester or polyamide and polystyrene segments. In manufacturing a hollow composite fiber composed of alternately arranged segments of polyester or polyamide and polystyrene which are mutually adhered side-by-side and encompass a hollow space, the drawing operation of the melt-spun hollow composite fiber was very difficult, because the adhesive force between the segments of different polymers was poor and the physical properties of the segments of different polymers greatly differed from each other, and accordingly it was very difficult to obtain the hollow composite fiber suited for commercial use.

SUMMARY OF THE INVENTION

It has now been found by the present inventors that a hollow composite fiber composed of polyester or polyamide and polystyrene segments and having a specific denier and specific structure has good melt-forming properties in the melt-spun and drawing processes and can be preferably used for the preparation of leatherlike sheet materials having excellent properties.

The present invention relates to a process for the preparation of leatherlike sheet materials which comprises the steps of:

(1) preparing hollow composite fibers, each composed of 32 to 72 alternately arranged segments of polyester or polyamide and polystyrene which are mutually adhered side-by-side and encompass a hollow space, and which extend along the longitudinal axis of the fiber to form a tubular body, said hollow composite fiber having a denier of 1 to 20, and said each segment having a denier of 0.01 to 0.5, the hollow ratio being 2–15%;

(2) forming a fabric using thus prepared hollow composite fibers;

(3) removing the polystyrene segments with a solvent thereof from the hollow composite fibers; and (4) applying an elastic polymer to the fabric.

DESCRIPTION OF THE PREFERRED EMBODIMENTS

Figure 1:
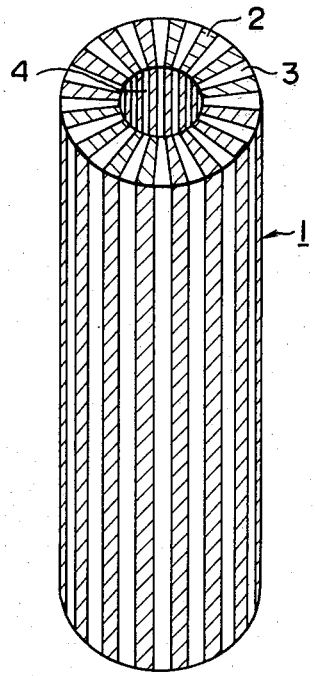
FIG. 1 is a schematic cross-sectional view of a hollow composite fiber used in the present invention.

The hollow composite fiber employed in the present invention has a schematic cross-section as illustrated in FIG. 1 (a hollow composite fiber having the total segments of 32). In FIG. 1, the hollow composite fiber 1 is composed of polyester or polyamide segments 2, polystyrene segments 3 and a center hollow space 4. The polyester or polyamide and polystyrene segments 2 and 3 as well as the center hollow space 4 extend along the longitudinal axis of the fiber 1. The polyester or polyamide segments 2 and the polystyrene segments 3 are arranged alternately around the center hollow space 4 and mutually adhered side-by-side so as to form a tubular fiber body. In the embodiment of FIG. 1, the hollow space 4 is formed around the longitudinal axis of the fiber 1, and the polyester or polyamide segments 2 and polystyrene segments 3 are regularly and alternately arranged around the center hollow space 4. However, the hollow space 4 may also be formed eccentrically with respect to the longitudinal axis, and the polyester or polyamide segments 2 and polystyrene segments 3 may be arranged around such an off-centered hollow space 4 to have irregular and different cross-sectional configurations and areas.

The hollow composite fiber employed in the present invention is composed of 16 to 36, of the polyester or polyamide segments and of the corresponding number of polystyrene segments. When the total number of the segments is less than 32, the composite fiber tends to separate into each segment or break in the process of melt-spinning and/or drawing. On the contrary, when the total number of the segments is more than 72, two or more segments of polyester or polyamide in the composite fiber tend to adhere to each other, and accordingly it is difficult to obtain extra fine uniform fibers having a desired denier.

The denier of each segment in the hollow composite fiber must be in the range of 0.01 to 0.5, preferably 0.05 to 0.3. When the denier is less than 0.01, two or more segments of polyester or polyamide in the composite fiber tend to adhere to each other, and further the manufacturing process control is very difficult. On the contrary, when the denier is more than 0.5, the composite fiber tends to separate into each segment in the process of melt-spinning and/or drawing. The denier of hollow composite fibers is in the range of 1 to 20. When the denier is less than 1 or more than 20, it is difficult to produce the hollow composite fiber. The ratio of the total weight of the polyester or polyamide segments to that of the polystyrene segments is not necessarily limited, although a ratio of between 50:50 and 70:30 is preferable. In the hollow composite fiber employed in the present invention the hollow ratio, i.e., the ratio by volume of the hollow space to the sum of the volume of the polyester or polyamide segments, the polystyrene segments and the hollow space, is between 2 and 15% by volume. If the hollow ratio is less than 2%, segment separability is poor while if it is more than 15%, melt-spinning and drawing workability are poor. The hollow ratio can be determined by the following method. A cross-sectional profile at some point along the fiber is observed, from which the cross-sectional area of the hollow space and that of the fiber body are measured. The ratio of the cross-sectional area of the hollow space to that of the fiber body is determined from these measured values. The same procedures are repeated 20 times at different points along the fiber. The hollow ratio of the fiber represents a mean value of the determined values of the ratios. When the hollow composite fibers have a hollow ratio of between 1 and 30% by volume, the hollow composite fibers can be processed by, for example, a melt-spinning operation, a drawing operation, and a weaving operation without the individual segments being separated from each other. The polystyrene segments in thus obtained hollow composite fiber are readily dissolved with a solvent thereof to form extra fine fibers composed of individual polyester or polyamide segments.

In the present invention, the polyester used for the polyester segments may be selected from the group consisting of (1) alkylene terephthalate homopolyesters, in which the alkylene group is derived from polymethylene glycol of the formula: $HO—(CH_2)_p—OH$, where p represents an integer of from 2 to 10 and (2) alkylene terephthalate—third ingredient copolyesters, in which the alkylene group is the same as defined above and the third ingredient is derived from at least one compound selected from the group consisting of adipic acid, sebacic acid, isophthalic acid, diphenylsulfone-dicarboxylic acid, naphthalenedicarboxylic acid, hydroxybenzoic acid, propylene glycol, cyclohexane-dimethanol and neopentyl glycol, in an amount of 10% or less by mole based on the amount of the alkylene terephthalate ingredient. The polyester used for the polyester segments may also be a blend of two or more of the above-mentioned homopolyesters and the copolyesters. Among these polyesters, polyethylene terephthalate is particularly preferable. The preferable polyesters in the present invention have an intrinsic viscosity of between 0.4 and 1.2 when measured at 35° C. in O-chlorophenol.

The polyamide used for the polyamide segments may be selected from the group consisting of nylon 4, nylon 6, nylon 66, nylon 7, nylon 610, nylon 11, nylon 12, polyamides of bis(p-aminocyclohexyl) methane with a dicarboxylic acid such as 1,7-heptanedicarboxylic acid and 1,10-decamethylenedicarboxylic acid, copolyamides of two or more of the above-mentioned polyamides and mixtures of two or more of the above-mentioned polyamides and copolyamides. Among these polyamides, nylon 6 and nylon 66 are particularly preferable. The preferable polyamides in the present invention have an intrinsic viscosity of between 1.0 and 1.3 when measured at 35° C. in m-cresol.

The polyester or polyamide segments may contain therein an anti-static agent, a delustering agent such as titanium dioxide, a coloring agent such as carbon black, and an anti-oxidizing agent having thermal stability.

In the present invention, the polystyrene used for the polystyrene segments may be selected from the group consisting of (1) a homopolymer of styrene and (2) styrene-copolymers obtained by copolymerizing more than 80% by weight of styrene with less than 20% by weight of other vinyl compounds. As for vinyl compounds copolymerizable with styrene, there are exemplified vinyltoluene, chlorostyrene, acrylonitrile, ethylene, propylene, butylene, butadiene and isoprene. The preferable polystyrenes in the present invention have a melt index of between 10 and 30.

The process for the preparation of the hollow composite fiber as shown in FIG. 1 is illustrated in the following paragraphs.

Figure 2:
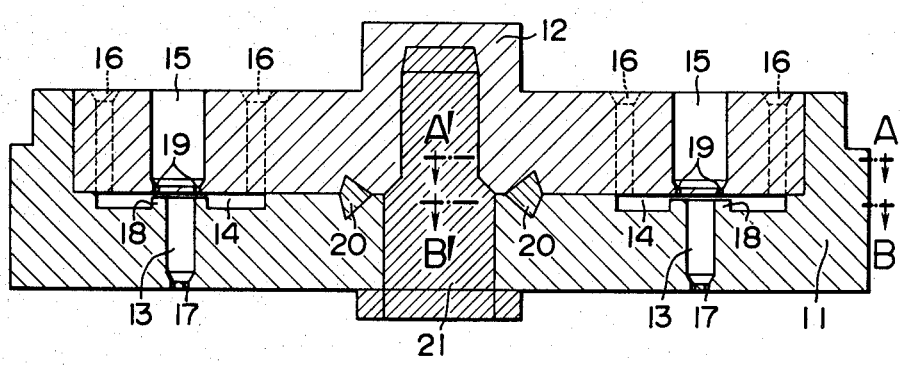
FIG. 2 is an axial cross-sectional view of a spinneret used for producing a hollow composite fiber.
Figure 3:
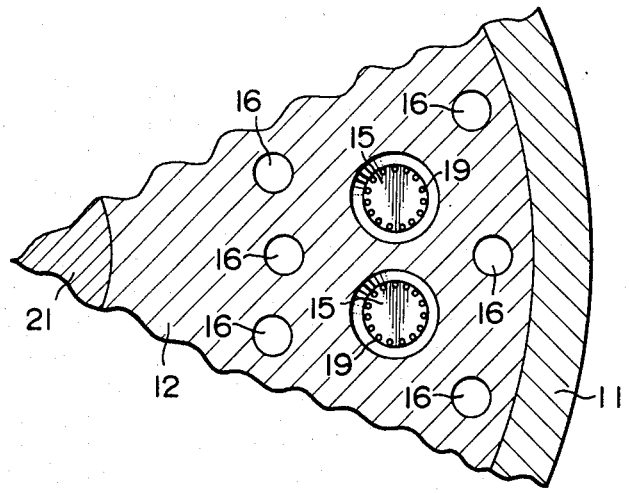
FIG. 3 is a partial transverse cross-sectional view of the spinneret of FIG. 2 taken at line A—A'.
Figure 4:
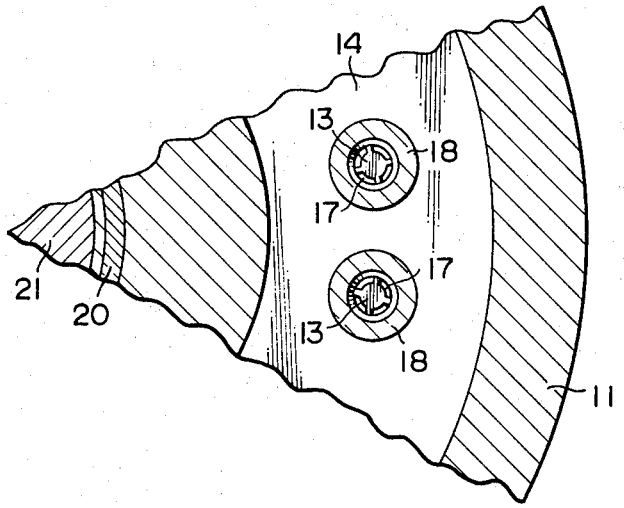
FIG. 4 is a partial transverse cross-sectional view of the spinneret of FIG. 2 taken at line B—B'.

FIG. 2 shows an axial cross-sectional view of a spinneret used for producing the hollow composite fiber as shown in FIG. 1 (the hollow composite fiber having the total segments of 32). FIG. 3 shows a partial transverse cross-sectional view of the spinneret of FIG. 2 taken at line A—A'. FIG. 4 shows a partial transverse cross-sectional view of the spinneret of FIG. 2 taken at line B—B'.

In the spinneret of FIG. 2, the top plate 12 is fixed to the bottom plate 11 with a set-screw 21 and is sealed against the bottom plate 11 by gasket 20. The bottom plate 11 has a recessed region which forms a narrow fluid passage 14 between the bottom plate 11 and top plate 12. This fluid passage 14 is formed in the form of circular groove as shown in FIG. 4. The bottom plate 11 has a plurality of spinning orifices 13, each of which has four circularly arranged slits 17 in the bottom portion as shown in FIG. 4 and an upper opening which communicates with the fluid passage 14 passing through a plateau-like protrusion 18. The number of slits is in the range of 1 to 8, and preferably 4. The top plate 12 has a guide hole 15 for the first melted polymer and a plurality of guide holes 16 for the second melted polymer corresponding in number to each spinning orifice 13. The guide holes 16 for the second melted polymer are formed in fours around the guide hole 15 for the first melted polymer as shown in FIG. 3. The number of guide holes for the second melted polymer is not necessarily limited, although a number of between 1 and 6 corresponding to each guide hole for the first melted polymer is preferable. The guide hole 15 for the first melted polymer communicates with the fluid passage 14 through sixteen circularly arranged small orifices 19 (as shown in FIG. 3) which are formed in the bottom of the guide hole 15 for the first melted polymer. The small orifices 19 are so arranged that the first melted polymer extruded through the small orifices 19 may impinge on the plateau of the protrusion 18. Upper opening of the guide hole 15 for the first melted polymer communicates with the supply means (not shown) of the first melted polymer. Lower and upper openings of the guide hole 16 for the second melted polymer are communicated with unprotruded regions of the fluid passage 14 and the supply means (not shown) of the second melted polymer respectively.

The number of small orifices 19 formed in the bottom of each guide hole 15 for the first melted polymer must be as same as the number of segments formed from the first melted polymer in the obtained hollow composite fiber. Accordingly, the number of small orifices is in the range of 8 to 48, preferably 16 to 36 in the present invention.

The first melted polymer is supplied to the guide hole 15 for the first melted polymer from the supply means (not shown) and impinges on the plateau of the protrusion 18 through the small orifices 19 to form sixteen fine streams of the first melted polymer, which streams are led to the spinning origice 13. The second melted polymer is supplied to the guide holes 16 for the second melted polymer from the supply means (not shown) and led to the fluid passage 14, and contacts with the first melted polymer after its flow having been streamlined uniformly by the protrusion 18. The both melted polymers, contacting each other, form a composite stream composed of the sixteen first melted polymer fine streams, each being surrounded by the second melted polymer, which composite stream is led to the spinning orifice 13 and extruded through four slits 17 to make a hollow composite fiber having 32 segments as shown in FIG. 1.

In the present invention, polyesters or polyamides and polystyrenes are used as the polymers for the first and the second melted polymers respectively.

Polyesters or polyamides used for the first melted polymer have preferably a melt viscosity of 1000 to 3500 poises, and polystyrenes used for the second melted polymer have preferably a melt viscosity of 500 to 1500 poises. In the melt spinning operation, it is preferable that the melt spinning temperature is between 280° and 300° C. and the take-up speed of spun filaments (undrawn filaments) is between 500 and 2000 m/min.

In the present invention, the ratio of the feeding speed (g/min) of polyesters or polyamides to that of polystyrenes is in a range of between 50:50 and 70:30. It is possible to obtain a hollow composite fiber having segments of desired cross-sectional configurations and areas by varying the ratio within the abovementioned range. Thus obtained undrawn filaments are drawn at a draw ratio of 2 to 5 to form the hollow composite fibers (drawn filaments) used in the present invention. In the drawing operation, it is preferable that the drawing temperature is between 40° and 130° C. under wet or dry conditions and the take-up speed of drawn filaments in between 300 and 1000 m/min.

In the present invention, a fabric is formed using thus obtained hollow composite fibers. The fabric means a non-woven, woven and knitted fabrics as well as a composite thereof in the present invention.

As for non-woven fabrics, there are a web and a felty product made from the hollow composite fibers of the present invention or a mixture of the hollow composite fibers and conventional fibers each having a denier of more than about 1. The web may be formed by using a conventional apparatus for producing non-woven fabrics, such as a carding machine, cross wrapper and random webber, or formed by a method of direct fabrication. The felty product may be formed by needlepunching a plurality of webs arranged in layers.

The felty product may also be formed by needlepunching the webs together with a web, woven or knitted fabric consisting of conventional fibers arranged in layers.

The density of needlepunching can be determined in accordance with the requirements of the end uses of the non-woven fabrics, and preferably between 200 to 800 needles/cm$^2$. The formation of the felty products can also be performed by the stitch bonding method using such machines as "Arachne," "Maliwatt" or "Mlipol". One or both surfaces of the felty product may be raised by using a conventional raising machine, such as a roller sander machine with sand paper or emery cloth.

The woven fabric is prepared from a multifilament yarn or a spun yarn consisting of the hollow composite fibers of the present invention as the warp and/or weft of the woven fabric by using a conventional loom. One or both surfaces of the woven fabric may be raised by using a conventional raising machine, such as emery raising machine, teazel raising machine, wire raising machine, or a roller sander machine with sand paper or emery cloth. As for the woven fabrics used for the raised woven fabrics, a satin fabric is preferably used, which is composed of a multifilament yarn or a spun yarn consisting of the hollow composite fibers of total denier ranging from 50 to 500 as the weft, and a multifilament yarn, a mixed multifilament yarn, a spun yarn or a mixed spun yarn consisting of the conventional fibers (whose monofilament denier is more than about 1) of total denier ranging from 50 to 300 as the warp. When it is desired to raise two surfaces (a surface or back surface) of the fabric, a double faced woven fabric having a satin structure in both surfaces is preferably used. Among the satin fabrics, 3-ply satin and 4-ply satin fabrics are particularly preferable. In particular, a textured yarn having crimps which consists of polyesters, such as polyethylene terephthalate or polyamides, such as nylon 6 and nylon 66 is preferably used as the warp yarn.

The knitted fabric is prepared from a multifilament yarn or a spun yarn consisting of the hollow composite fibers of the present invention by using a conventional knitter. When a warp knitted fabric is employed, it is preferable that the front yarns thereof are formed with a multifilament yarn or a spun yarn consisting of the hollow composite fibers and the back yarns thereof are formed with a multifilament yarn, a mixed multifilament yarn, a spun yarn or a mixed spun yarn having the conventional denier. When a circular knitted fabric is employed, it is preferable that both the front and back portions or only the front portion thereof are formed with a multifilament yarn or a spun yarn consisting of the hollow composite fibers. One or both surfaces of the knitted fabric may be raised as in the case of the woven fabric.

In the present specification, the multifilament yarn means, for example, a single twist filament yarn, an untwisted filament yarn, a twin filament yarn, a triple filament yarn, a "Taslan" textured yarn (trademark of Du Pont) or a textured yarn having crimps obtained by a method such as false-twisting, stuffer crimping, edge crimping and air jet-crimping. The mixed multifilament yarn means a multifilament yarn consisting of two or more different filaments.

In the present invention, thus obtained fabric is treated with a solvent of polystyrenes to remove the polystyrene segments of the hollow composite fibers contained in the fabric. All the polystyrene segments of the hollow composite fibers are substantially removed with a solvent such as benzene, toluene, trichloroethylene and perchlorethylene at room or elevated temperature. Accordingly, the fabric containing extra fine fibers is obtained, which extra fine fibers consist essentially of polyester or polyamide segments, each having a denier of 0.01 to 0.5. This operation of removing the polystyrene segments of the hollow composite fibers may be conducted after the process of applying an elastic polymer to the fabric as disclosed below.

The abovesaid operation of raising the fabric may be conducted after the operation of removing the polystyrene segments and before the process of applying an elastic polymer to the fabric. If desired or necessary, shearing, buffing or brushing operation may be conducted on the raised fabric after the operation of removing the polystyrene segments from the hollow composite fibers.

In the present invention, an elastic polymer is applied to thus obtained fabric (a fabric obtained before or after the operation of removing the polystyrene segments from the hollow composite fibers). As for the elastic polymers, there are natural rubber and synthetic elastic polymers such as acrylonitrile-butadiene copolymers, polychloroprene, styrene-butadiene copolymers, polybutadiene, polyisoprene, ethylene-propylene copolymers, acrylate-type copolymers, silicone, polyurethanes, polyacrylates, polyvinyl acetate, polyvinyl chloride, polyester-polyether block copolymers, ethylenevinyl acetate copolymers, etc. The method which comprises applying an urethane pre-polymer to the fabric and then heating the applied fabric to form a polyurethane in the fabric is also preferably employed in the present invention.

The elastic polymer is applied to the fabric in the form of a solution such as an organic solvent solution, aqueous solution or emulsion of the elastic polymer. For applying the solution of the elastic polymer, there may be adopted a method of impregnating the fabric with the solution, a method of coating the surface or back-side surface of the fabric with the solution or a method of spraying the solution on the fabric. The impregnating method and back-side coating method are preferably employed in the present invention. In the impregnating or spraying method, it is preferable to use a solution having an elastic polymer concentration within a range of 1 to 50% by weight of the solution. In the coating method, it is preferable to use a solution having an elastic polymer concentration within a range of 5 to 50% by weight of the solution. The amount of the elastic polymer (dry weight) applied to the fabric is determined in accordance with the required end use of the obtained leatherlike sheet materials, although an amount of 0.5 to 150% based on the weight of the fabric is preferable. After the application, the elastic polymer is solidified or coagulated by any well-known method to form a leatherlike sheet material.

As for the urethane pre-polymers, there are preferably exemplified hydroscopic and heat-active urethane pre-polymers having one or more isocyanate groups blocked by bisulfites, and particularly having an oxyethylene group of 10 to 40% by weight in the molecule as disclosed in Japanese Patent Application Laid-Open Nos. 108395/75 and 155794/75. The urethane pre-polymer is applied to the fabric in the form of an aqueous solution or emulsion, and thereafter the applied fabric is dried and heated at a temperature of 100° to 180° C. for 10 seconds to 15 minutes. Upon heat-treating, the urethane pre-polymer in the fabric releases bisulfites blocking isocyanate groups to regenerate active isocyanate groups, and accordingly to form a polyurethane by a self-cross-linking reaction.

The fabric of the present invention may be dyed or printed according to any conventional method before or after the process of applying the elastic polymer.

If desired or necessary, the elastic polymer applied fabric—the leatherlike sheet material—is buffed or brushed by any conventional method. If necessary, decatizing operation may be conducted on the brushed leatherlike sheet material. Further, in the present invention, it is possible on or after the process of applying the elastic polymer to carry out water repellent, water proofing, soil resistant, antistatic, slime imparting, flame resistant and fire proofing treatments.

The leatherlike sheet material obtained in accordance with the present invention has fine touch, excellent repulsive elasticity and excellent wrinkle resistance. Accordingly, the leatherlike sheet material obtained in accordance with the present invention has wide varieties of use as clothing, such as jackets, jumpers, blazers, skirts, trousers, shorts, slacks, dresses, suits, vests, coats and gloves, bags, boots and chair covers.

The following examples are illustrative of the present invention, but are not to be construed as limiting the scope of the present invention.

EXAMPLE 1

[Preparation of hollow composite fibers]

Hollow composite filaments were prepared with polyethylene terephthalate having an intrinsic viscosity of 0.60 (at 35° C. in O-chlorophenol) as the polymer for the first melted polymer and polystyrene having a melt index of 20 as the polymer for the second melted polymer by using the spinneret as shown in FIG. 2 (The number of spinning orifices was 20). The number of small orifices 19 formed in the bottom of each guide hole 15 for the first melted polymer was six, eight, sixteen, thirty-two and forty in the Experiment Nos. 1, 2, 3, 4 and 5 respectively. The first and second melted polymers were supplied to the respective guide holes at a feeding speed of 9 g/min, and hollow composite filaments were spun at a temperature of 285° C. at a take-up speed of 900 m/min. The obtained undrawn filaments were drawn at a temperature of 110° C. at a draw ratio of 4.0 to obtain hollow composite filaments, each having a denier of 2.3 and a hollow ratio of 5%. The physical properties of the obtained hollow composite filaments are shown in Table 1.

TABLE 1

| | Total number of segments | Denier of each segment *1 | Workability in melt-spinning and drawing *2 | Separability of segments (%) *3 |
|---|---|---|---|---|
| Experiment No. 1 | 12 | 0.20 | Poor | 100 |
| Experiment No. 2 | 16 | 0.14 | Good | 100 |
| Experiment No. 3 | 32 | 0.07 | Excellent | 100 |
| Experiment No. 4 | 64 | 0.04 | Excellent | 100 |
| Experiment No. 5 | 80 | 0.03 | Excellent | 80 |

Footnotes on Tables 1 and 2:
*1: A value calculated from the denier of the hollow composite fiber and the total number of segments of the hollow composite fiber. The calculated value equals the measured value when the separability of segments is 100%.
*2: Workability in melt-spinning and drawing of the hollow composite fibers.
Excellent - The hollow composite fibers hardly separate into each segment and can be smoothly processed in the melt-spinning and drawing operations.
Good - The hollow composite fibers slightly separate into each segment but can be processed practically in the melt-spinning and drawing operations.
Poor - The hollow composite fibers considerably separate into each segment, and hence the process control in the melt-spinning and drawing operations is difficult.
*3: Separability of segments is shown as a percentage of a value which is calculated dividing the total number of obtained polyester or polyamide segments after all the polystyrene segments are removed from the hollow composite fiber by the total number of polyester or polyamide segments contained in the hollow composite fiber. 100% separability means that all the segments completely separate into each segment. 50% separability means that segments are found adhering to each other in twos on the average.

In Experiment No. 1 (where the total number of segments was out of the scope of the present invention) in Table 1, it is very difficult to obtain the hollow composite fibers due to poor workability in melt-spinning and drawing of the fibers. On the other hand, in Experiment Nos. 3 to 5 (where the total number of segments were within the scope of the present invention), excellent hollow composite fibers were smoothly obtained due to good workability in melt-spinning and drawing of the fibers. In Experiment 2, outside the scope of the present invention, only good results were obtained. Among these, the hollow composite fibers obtained according to Experiment No. 5 (where the total number of segments was 80) had separability of segments of 80%. It means that a part of polyethylene terephthalate segments are found existing in twos in the average adhering to each other. Accordingly, when the total number of segments is too many (when the total number of segments is more than 72), separability of segments of the hollow composite fiber becomes to be poor, which is not preferred in the present invention.

[Preparation of a woven fabric]

A woven fabric was prepared with hollow composite filaments obtained according to Experiment No. 3. As for the weft yarn, a single twist filament yarn of this hollow composite multifilaments (600 deniers/260 filaments) having a twist number of S 150 T/m was used. As for the warp yarn, a twin filament yarn (200 deniers) consisting of two 100 denier/24 filament wooly (false twisted) yarns of polyethylene terephthalate and having a twist number of S 150 T/m was used. A 4-ply satin was prepared from the warp and weft yarns, the woven density of which was 70 warps/inch and 56 wefts/inch.

The resultant woven fabric was relaxed in a hot water bath at a temperature of 98° C. for 30 minutes, and dried at a temperature of 120° C. for 3 minutes. Thereafter, the woven fabric was washed 5 times with trichloroethylene to substantially remove all the polystyrene segments. After drying, an oiling agent mainly containing mineral oil was applied to the dried fabric. Thereafter, one surface of the fabric was raised 15 times with a wire raising machine having a plurality of 33 count wires at a running speed of 30 m/minute. The raised fabric was then pre-heat set at a temperature of 170° C. for 30 seconds using a pin tenter type heat setter.

Thereafter, the pre-heat set fabric was dyed at a temperature of 130° C. for 60 minutes in an aqueous dyeing bath containing 4% (based on the weight of the fabric) of Duranol Blue G (C.I. No. 63305, trademark for a disperse dye produced by I.C.I.), 0.2 ml/l of acetic acid, and 1 g/l of a dispersing agent mainly containing a condensation product of naphthalene sulfonic acid with formamide. The fabric was then soaped with an aqueous solution containing a nonionic detergent at a temperature of 80° C. for 20 minutes, and dried at a temperature of 120° C. for 3 minutes.

[Preparation of a leatherlike sheet material]

The raised and dyed woven fabric was finished with a polyurethane in the following manner. The fabric was immersed in a 3.6% by weight aqueous emulsion of a mixture of 2.3% by weight polyurethane (reaction product of methylene-diphenyldiisocyanate, polyethylene glycol, and 1,4-butane diol), 1.0% by weight polybutyl acrylate, and 0.3% by weight of a polyester-polyether block copolymer (a block copolymer consisting of 40% by weight of a polyester of terephthalic acid and 1,4-butane diol, and 60% by weight of polytetramethyleneglycol). The fabric was then squeezed to an emulsion pick-up ratio of 70% based on the weight of the fabric and dried at a temperature of 120° C. for 3 minutes, after which it was heat-set at a temperature of 150° C. for 30 seconds to obtain a leatherlike sheet material. The leatherlike sheet material was buffed one time by a roller sander machine with sand paper of 100 mesh size, followed by brushing.

The obtained leatherlike sheet material had suede-like appearance, fine touch, excellent suppleness and excellent pilling resistance.

EXAMPLE 2

A leatherlike sheet material was prepared in accordance with the method for applying an urethane prepolymer to the raised and dyed fabric as obtained in Example 1

[Preparation of an urethane pre-polymer]

An urethane pre-polymer having isocyanate groups was prepared by reacting a mixture at a temperature of 100° to 105° C. for one hour in a stream of nitrogen gas, which mixture consists of the following compounds: (1) 21 parts of a block-copolymerized polyether diol having a number average molecular weight of 2,400 which was obtained by reacting polypropylene glycol having a number average molecular weight of about 1,200 with ethylene oxide; (2) 56 parts of a polyester diol which was obtained by reacting adipic acid, 1,6-hexane diol and neopentyl glycol in a molar ratio of 10:7:4 respectively; (3) 3 parts of 1,6-hexane diol; and (4) 20 parts of hexamethylene diisocyanate.

The isocyanate group and oxyethylene group contents in the resultant urethane pre-polymer were 5.02% and 10.2% by weight respectively.

After cooling to 40° C., 20 parts of dioxane was added to the resultant urethane pre-polymer to form a solution of the pre-polymer. The obtained solution was mixed thoroughly with 65 parts of an aqueous solution of sodium bisulfite having a concentration of 25% by weight at a temperature of 40° C. for 30 minutes. Thereafter, 202 parts of water was added to the reaction mixture to obtain an aqueous solution of the urethane pre-polymer having a concentration of about 30% by weight.

[Preparation of a leatherlike sheet material]

The raised and dyed woven fabric as obtained in Example 1 was immersed in an 8% by weight aqueous solution of the abovementioned urethane pre-polymer, and then squeezed to a pick-up ratio of 70% based on the weight of the fabric. The squeezed fabric was dried at a temperature of 100° C. for 3 minutes and heat-treated at a temperature of 140° C. for 30 seconds to obtain a leatherlike sheet material. The raised surface of the leatherlike sheet material was then buffed one time by a roller sander machine with sand paper of 100 mesh size, followed by brushing.

The obtained leatherlike sheet material had fine touch, excellent repulsive elasticity, excellent wrinkle recovery and excellent writing effect similar to natural suede.

EXAMPLE 3

[Preparation of a non-woven fabric]

After forming a fiber bundle consisting of the undrawn hollow composite yarns as obtained in Experiment No. 3 of Example 1 using a creel stand, the fiber bundle was drawn at a temperature of 60° C. in a water bath at the drawing ratio of 3.75, and bestowed 15 crimps/inch using a stuffing box and cut into length of 38 mm to make staple fibers. The staple fibers were fed to a cross-wrapper to make webs. Two of the webs were laid one over the other and needlepunched with a needlepunching density of 800 needles/cm$^2$ to obtain a felty product having a weight of 200 g/m$^2$.

[Preparation of a leatherlike sheet material]

The obtained felty product—non-woven fabric—was immersed in a 20% by weight dimethylformamide solution of polyurethane (reaction product of methylenediphenyl-diisocyanate, polyethylene glycol, and 1,4-butane diol). The fabric was then squeezed to a solution pick-up ratio of 100% based on the weight of the fabric, and thereafter immersed in water to coagulate the polyurethane in the fabric. After drying, the fabric was immersed in trichloroethylene at room temperature for 3 hours to substantially remove all the polystyrene segments in the hollow composite fibers. The surface of the obtained leatherlike sheet material was buffed one time by sand paper.

The resultant leatherlike sheet material, which was made from a non-woven fabric, had fine touch and excellent repulsive elasticity similar to natural suede.

EXAMPLE 4

[Preparation of hollow composite fibers]

Hollow composite filaments were prepared from poly-ε-caproamide (nylon 6) having an intrinsic viscosity of 1.10 (at 35° C. in m-cresol) as the polymer for the first melted polymer and polystyrene having a melt index of 30 as the polymer for the second melted polymer by using the spinneret as shown in FIG. 2 (The number of spinning orifices was twenty and the number of small oridices 19 formed in the bottom of each guide hole 15 for the first melted polymer was sixteen).

The first and second melted polymers were supplied to the respective guide holes at a feeding speed of 10.8 g/min and 7.2 g/min respectively, and hollow composite filaments were spun at a temperature of 255° C. at a take-up speed of 1000 m/min. The obtained undrawn filaments were drawn at a temperature of 110° C. at a draw ratio of 3.0 to obtain hollow composite filaments, each having a denier of 2.6 and a hollow ratio of 6.5%. Each polyamide and polystyrene segment had a denier of 0.10 and 0.06 respectively. The physical properties of the obtained hollow composite filaments are shown in Table 2, Experiment No. 6.

On the other hand, two kind of hollow composite filaments were prepared by the same procedure as the abovementioned process, except that the feeding speed of the first and second melted polymers were 13.5 g/min and 4.5 g/min respectively for one kind and the feeding speed of the first and second melted polymers were 8.1 g/min and 9.9 g/min respectively for the other. The former hollow composite filament had a denier of 22.6 and a hollow ratio of 8.5%. Each polyamide and polystyrene segment in the former had a denier of 0.13 and 0.04 respectively. The latter hollow composite filament had a denier of 2.6 and a hollow ratio of 3.0%. Each polyamide and polystyrene segment in the latter had a denier of 0.08 and 0.09 respectively. The physical properties of the obtained hollow composite filaments are shown in Table 2, Experiment Nos. 7 (the former) and 8 (the latter). Since the ratio of the feeding speed of polyamide to that of polystyrene was 75:25 in Experiment No. 7 and 45:55 in Experiment No. 8, which were out of the preferred scope of the present invention, the hollow composite fibers had poor workability in melt-spinning and drawing.

TABLE 2

| | Total number of segments | Ratio of the feeding speed of the first and second polymers | Workability in melt-spinning and drawing *2 | Separability of segments (%) *3 |
|---|---|---|---|---|
| Experiment No. 6 | 32 | 60:40 | Excellent | 100 |
| Experiment No. 7 | 32 | 75:25 | Poor | 100 |
| Experiment No. 8 | 32 | 45:55 | Poor | 100 |

[Preparation of a knitted fabric]

A tricot having a weight of 250 g/m$^2$ was prepared by using as a front yarn, a single twist filament yarn (S 150 T/m) of the hollow composite multifilaments (600 deniers/260 filaments) as obtained in Experiment No. 6, and as a back yarn, a filament yarn (150 deniers/48 filaments) of nylon 6.

The tricot was relaxed in a hot water bath at a temperature of 80° C. for 20 minutes, and dried at a temperature of 120° C. for 3 minutes. Thereafter, the tricot was washed 5 times with trichloroethylene to substantially remove all the polystyrene segments in the hollow composite fibers. The tricot was then dyed at a temperature of 100° C. for 40 minutes in an aqueous dyeing bath containing 4% (based on the weight of the tricot) of Suminol Milling Brilliant Red B (C.I. No. 18134, trademark for an acid dye produced by Sumitomo Chemical Co.) and 2 ml/l of acetic acid. The tricot was then washed with an aqueous solution containing a nonionic detergent at a temperature of 70° C. for 20 minutes, and dried at a temperature of 120° C. for 3 minutes.

[Preparation of a leatherlike sheet material]

The dyed tricot was immersed in a 2.4% by weight aqueous emulsion of a mixture of 1.2% by weight of an ethylene-vinyl acetate copolymer (a copolymer of equivalent moles of each component), 0.9% by weight polybutyl acrylate, and 0.3% by weight of a polyester-polyether block copolymer as used in Example 1, and was squuezed to an emulsion pick-up ratio of 70% based on the weight of the tricot and dried at a temperature of 120° C. for 3 minutes, and then heat-set at a temperature of 150° C. for 30 seconds. The resultant leatherlike sheet material was buffed one time by a roller sander machine with sand paper of 100 mesh size, followed by brushing.

The leatherlike sheet material had fine touch and excellent suppleness.

What is claimed is:

1. A process for the preparation of leatherlike sheet materials which comprises the steps of:

(1) preparing hollow composite fibers, each composed of 32 to 72 alternately arranged segments of polyester or polyamide and polystyrene which are mutually adhered side-by-side and encompass a hollow space, and which extend along the longitudinal axis of the fiber to form a tubular body, said hollow composite fiber having a denier of 1 to 20, and said each segment having a denier of 0.01 to 0.5, the ratio of the total weight of the polyester or polyamide segments to that of the polystyrene segments in the hollow composite fiber being in the range of between 50:50 and 70:30 and the hollow ratio of the hollow composite fiber being between 2 and 15% by volume;

(2) forming a fabric using thus prepared hollow composite fibers;

(3) removing the polystyrene segments with a solvent thereof from the hollow composite fibers; and (4) applying an elastic polymer to the fabric.

2. The process according to claim 1, wherein the polyester is polyethylene terephthalate.

3. The process according to claim 1, wherein the polyamide is nylon 6 or nylon 66.

4. The process according to claim 1, wherein the fabric is a woven fabric.

5. The process according to claim 4, wherein said polyethylene terephthalate has an intrinsic viscosity between 0.4 to 1.2 measured at 35° C. in o-chlorophenol and said polystyrene has a melt index between 10 to 20.

6. The process according to claim 1, wherein the fabric is a knitted fabric.

7. The process according to claim 1, wherein the fabric is a non-woven fabric.

8. The process according to claim 1, wherein the process of applying an elastic polymer to the fabric comprises applying an aqueous solution or emulsion of hydroscopic and heat-active urethane pre-polymer having an isocyanate group blocked by bisulfate to the fabric, and then heat-treating the applied fabric at a temperature of 100° to 180° C. to form polyurethane in the fabric.

9. The process according to claim 1, wherein the process of forming a fabric using the hollow composite fibers is followed by the process of applying an elastic polymer to the fabric and thereafter the process of removing polystyrene segments with a solvent thereof from the hollow composite fibers in the fabric.

10. The process according to claim 1, wherein said each segment has a denier of 0.05 to 0.3.

11. The process accordiang to claim 10, wherein said polyester or polyamide has a melt viscosity of 1,000 to 3,500 poises and said polystyrene has a melt viscosity of 500 to 1,500 poises.

12. The process according to claim 1, wherein said hollow composite fiber consists of 32 segments, 16 of which are polyester segments and 16 of which are polystyrene segments, encompassing said hollow space.

13. The process according to claim 12, wherein the denier of each segment is between 0.05 to 0.3.

14. The process according to claim 1, wherein said polyester segments and polystyrene segments are drawn at a draw ratio between 2 to 5 at a temperature between 40° to 130° C.

* * * * *